US008710704B2

(12) United States Patent
Lichter et al.

(10) Patent No.: US 8,710,704 B2
(45) Date of Patent: Apr. 29, 2014

(54) PERFORMANCE VENUE WITH DYNAMIC MECHANICAL LOAD MANAGEMENT SYSTEM AND METHOD

(75) Inventors: Michael Lichter, Holzkirchen (DE); Timothy P. Nolan, Madison, WI (US); Larry J. Gauthier, Middleton, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 423 days.

(21) Appl. No.: 12/772,737

(22) Filed: May 3, 2010

(65) Prior Publication Data

US 2011/0270437 A1 Nov. 3, 2011

(51) Int. Cl.
*H02H 11/00* (2006.01)

(52) U.S. Cl.
USPC ..... 307/326; 307/38; 307/39; 307/116; 307/125; 307/127; 700/213

(58) Field of Classification Search
USPC ..... 307/326, 38, 39, 237, 116, 125
See application file for complete search history.

(56) References Cited

U.S. PATENT DOCUMENTS 5,493,747 A * 2/1996 Inakagata et al. ..... 15/22.1
6,052,268 A * 4/2000 Thomas ..... 361/103
6,297,610 B1 * 10/2001 Bauer et al. ..... 318/562
7,042,180 B2 * 5/2006 Terry et al. ..... 318/400.21
2005/0231148 A1 * 10/2005 Pook et al. ..... 318/612
2009/0115390 A1 * 5/2009 Chen et al. ..... 323/283

FOREIGN PATENT DOCUMENTS

AU 2006209367 9/2006
JP 2002119774 4/2002
KR 100920161 10/2009

OTHER PUBLICATIONS

EP 11154764 European Search Report and Opinion, dated Aug. 8, 2011, 6 pages.

* cited by examiner

*Primary Examiner* — Stephen W Jackson
*Assistant Examiner* — Toan Vu
(74) *Attorney, Agent, or Firm* — Michael Best & Friedrich LLP

(57) ABSTRACT

A performance venue having a dynamic load management system for use in managing loads. The system uses a dead man circuit as a means for determining the actual or anticipated dynamic load produced by moving loads, and then disables the system by opening the dead man circuit when too many loads are moved or selected to be moved. Preferably, the invention is embodied in a dead man circuit is pure hardware, and is free of software components. The invention also provides a method of controlling movement of loads in a performance venue having a plurality machines. In its basic form, the method comprises selecting at least one of the machines for movement, closing a dead man circuit, and opening the dead man circuit if the current in the dead man circuit falls outside a predetermined range.

19 Claims, 5 Drawing Sheets

PERFORMANCE VENUE WITH DYNAMIC MECHANICAL LOAD MANAGEMENT SYSTEM AND METHOD

FIELD OF THE INVENTION

The present invention relates to entertainment venues that have multiple mechanical loads being moved, such as lighting, scenery, curtains, etc., and specifically to a system for controlling movement of the loads.

BACKGROUND OF THE INVENTION

Performance venues such as theaters, arenas, concert halls, auditoriums, convention centers, television studios, and the like can employ battens or trusses to raise and lower lighting, scenery, set-pieces, displays, draperies, and other items. Lift assemblies, or hoists, are typically used to raise and lower battens or trusses and attached loads. The lift assemblies are commonly connected directly to the support structure of a building, for example, to overhead beams. In some lift systems, multiple lift assemblies, or machines, can be employed for moving heavy loads, and can be connected to the same support structure.

Variable numbers of lift machines can be selected to operate for moving particular loads, such as a stage curtain and scenery. In a situation in which the stage curtain and scenery need to be raised at the same time, two lift machines can be selected to operate simultaneously. When multiple lift assembly machines are started, stopped, sped up, or slowed down at the same time, the moving mass and inertia of the machines and attached loads can place a large dynamic load on the support structure. As used herein, "dynamic load" refers to a dynamic mechanical load created by the acceleration or deceleration of a mass. For example, dynamic load on a building structure can be created by the force exerted by the inertia of starting, stopping, speeding up, or slowing down one or more accessories connected to the structure.

In locations where lift assemblies are installed, for example, to the "flytower" above a stage, the building support structure is often designed to handle the dynamic load of only a few lift machines starting and/or stopping at the same time. If too many lift machines are started and/or stopped at the same time, the associated dynamic load can cause damage to the support structure. Accordingly, the number of machines that are started or stopped at the same time may need to be limited in order to limit the dynamic load created.

Lift assembly systems that employ multiple lift machines often include a primary safety mechanism to prevent excessive dynamic loading on the support structure when the machines are started or stopped. Generally, such safety mechanisms are controlled through software. One risk of a software-based safety mechanism is that the software can malfunction or fail due to loss of power, inherent or acquired bugs, misuse by an operator, or other reasons. Thus, it is often desirable to have a dynamic load safety backup system that prevents the start of too many machines.

Some conventional multi-machine lift systems utilize an operator-activated safety backup mechanism to avoid overloading the building support structure to which a system is connected when multiple machines are started, stopped, or speed changed at the same time. For example, when signaled that an excessive dynamic load is being exerted by start-up of multiple machines, an operator can hit an "emergency stop" button to shut off power and stop operation of the machines. A significant disadvantage of such an operator-activated safety mechanism is that simultaneously stopping operation of multiple machines can suddenly release the excessive dynamic load in one direction and thereby create an excessive dynamic load on the support structure in the opposite direction. Another disadvantage is that such an operator-activated safety backup mechanism is engaged "after the fact," following initiation of an excessive dynamic load, and is dependent upon an operator monitoring for an excessive load.

Some conventional multi-machine lift systems utilize a software-based program as a safety backup mechanism to avoid an excessive dynamic load. Such software allows only a limited number of machines to be selected for movement at one time. One disadvantage of a software-based safety mechanism is that the software can malfunction or fail due to bugs in the software, or when used in applications that exceed software parameters. Another disadvantage of such a software-based safety mechanism is that certifying such systems for safety according to regulatory and/or industry standards can be complicated (if not impossible), time-consuming, and costly.

SUMMARY

The present invention provides a dynamic load management system that is particularly suited for use in managing the loads present in a performance venue, such as a theatre, auditorium, stage, television set, convention center, or any other similar forum. More specifically, the present invention is designed to use a dead man circuit as a means for determining the actual or anticipated dynamic load produced by moving loads, such as lighting, scenery, set-pieces, displays, draperies, and other items, and then disabling the system by opening the dead man circuit when too many machines are moved or selected to be moved. The system can be a primary dynamic load management system, or it can be a secondary or fallback system.

In one embodiment the invention is found in a performance venue comprising a plurality of machines (e.g., hoists) designed to move loads, a control center, a communication link coupling the control center to the machines, a machine switch (e.g., in each machine) coupled to the communication link and movable between an open position and a closed position, and a dead man circuit. The dead man circuit comprises a dead man enable switch movable between an open position and a closed position, a switching element (e.g., in each machine) coupled to the machine switch and operable to move the machine switch to the closed position, and a dead man trip that will open the dead man circuit when current in the dead man circuit is outside a desired range (e.g., when the actual current exceeds a max current). In a preferred embodiment, the dead man trip includes a current measuring device, a comparator coupled to the current measuring device, a trip contact, and a hold unit designed to hold the trip contact open when it is tripped.

Preferably, the control center includes a system controller coupled to the communication link and operable to provide a machine select command to each of the machines. In this design, each machine can include a machine controller coupled to the communication link and operable to receive the machine select command. The dead man circuit can further include a unit select switch corresponding with each machine, and wherein each machine controller is operable to move a corresponding unit select switch to a closed position. The dead man circuit preferably includes a plurality of parallel branches corresponding with the plurality of machines, each branch including a unit select switch, a switching element, and a current sink. In its most-preferred embodiment, the dead man circuit is pure hardware and is free of software components.

The present invention can also be found in a method of controlling movement of loads in a performance venue having a plurality machines for moving the loads. In its basic form, the method comprises selecting at least one of the machines for movement, closing a dead man circuit (e.g., by pressing a dead man button), and opening the dead man circuit if the current in the dead man circuit falls outside a predetermined range. Preferably, the dead man circuit includes a trip contact, and the step of the dead man circuit includes measuring the current in the dead man circuit, comparing the measured current to a maximum current, and opening the trip contact if the measured current exceeds the maximum current.

Features of a dynamic load management system and/or method may be accomplished singularly, or in combination, in one or more of the embodiments of the present invention. As will be realized by those of skill in the art, many different embodiments of a dynamic load management system and/or method are possible. Additional uses, advantages, and features of aspects of the present invention are set forth in the illustrative embodiments discussed in the detailed description herein and will become more apparent to those skilled in the art upon examination of the following.

DETAILED DESCRIPTION

Figure 1:
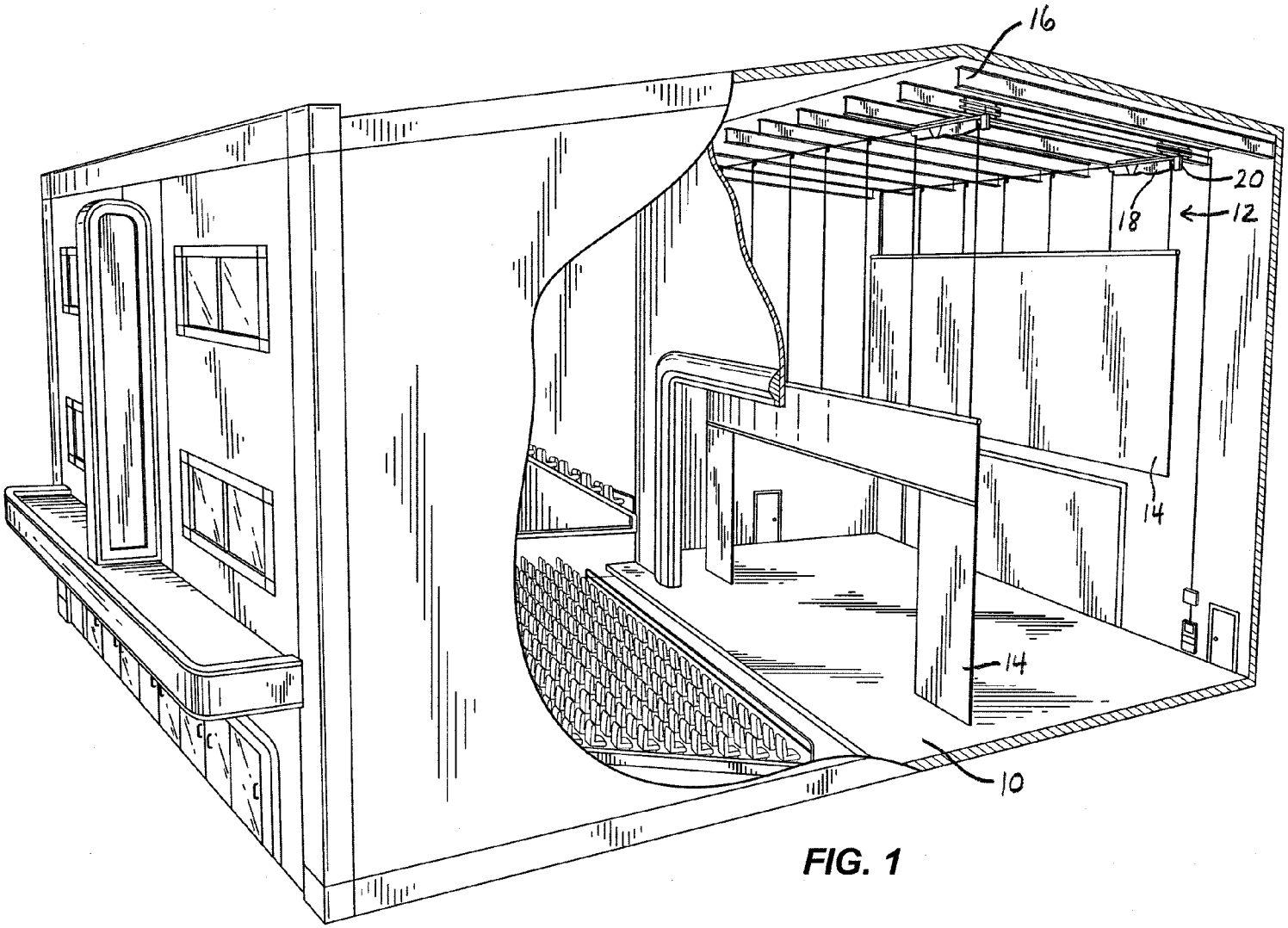
FIG. 1 is a perspective view of a theatre stage having several accessories and corresponding machines for moving the accessories.

FIG. 1 illustrates an performance venue in the form of a theatre. The theatre includes a stage 10 and overhead rigging 12 for movement of loads/accessories 14, such as scenery, lighting, curtains, set-pieces, displays, or any other entertainment accessory that might be used for an entertainment event. The overhead rigging is secured to overhead support members in the form of I-beam trusses 16, which are commonly present in entertainment venues. The rigging includes multiple lift machines 18 (e.g., hoists) that each includes a motor 20 that provides movement to an accessory. A particular theatre can include a large number of separate machines 18 and corresponding accessories. Such lift machines 18 are more fully described in co-owned, co-pending U.S. Patent Application No. 61/262,244, which is incorporated herein by reference in its entirety.

Figure 2:
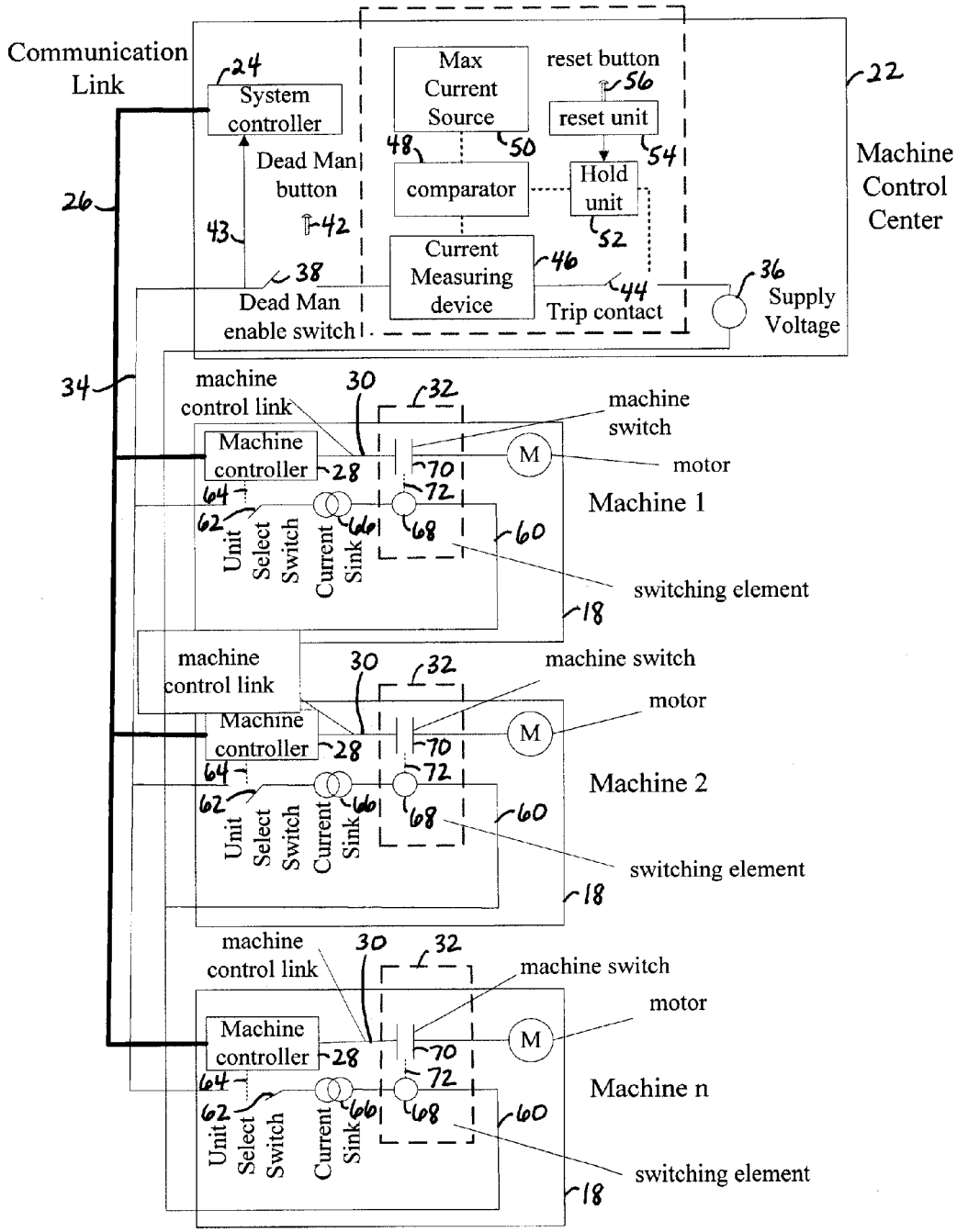
FIG. 2 is a schematic illustration of a dynamic load management system used to operate and control the lift machines in FIG. 1.

Referring to FIG. 2, in the illustrated embodiment, the machines 18 are controlled by a dynamic load management system having a control center 22, as shown in FIG. 2. The control center 22 includes a system controller 24 that is coupled to the machines 18 by a communication link 26, such as a serial bus. The system controller 24 is designed to receive input (e.g., from a user or from a software program) and initiate controlled movement of the machines 18 in a programmed manner. The system controller 24 can send at least two types of commands to the machines 18 via the communication link 26. The control center 22 can send a machine select command to the machines 18 to indicate to the signaled machines 18 that those machines 18 have been selected for movement. The control center 22 can also send a movement command to the selected machines 18 to cause the machines 18 to move under the desired conditions.

The communication link 26 is coupled to a machine controller 28 in each of the machines 18. The machine controller 28 is wired to the motor 20 of the corresponding machine 18 through a machine control link 30, which passes through a normally-open switching element 32.

The system controller 24 can be programmed in a variety of ways to achieve a software-based load management system. For example, the system controller 24 can be programmed such that select commands and movement commands can only be sent out to a limited number of machines 18 at any given time. In this way, the system provides a means for limiting the dynamic mechanical load that will be placed on the performance venue structure (e.g., that might be caused by simultaneous starting or stopping multiple machines 18).

A dead man circuit 34 is coupled between the control center 22 and the machines 18 to provide a hardware system for limiting the number of machines 18 that can be operated at any given time, thereby limiting the dynamic load created by the corresponding accessories. The illustrated dead man circuit 34 is hard-wired between the control center 22 and the machines 18, and includes no software for operation. In this regard, when the system controller 24 includes a programmed means for limiting the number of machines 18 that can be operated at any given time, the hardware system described below acts as a backup to the software system.

The portion of the dead man circuit 34 in the control center 22 includes a supply voltage 36, a dead man enable switch 38, and a dead man trip 40. The illustrated supply voltage 36 is a twenty-four volt source. The dead man enable switch 38 is normally open and can be manually closed by a user by pressing a dead man button 42. As with a typical dead man enable switch 38, the button 42 must be held by the user throughout the time that machines 18 are moving.

The closing of the dead man circuit 34 is sensed and communicated to the system controller 24 through a dead man status link 43. This information is used by the system controller 24 as an indication that the system is ready for machines 18 to move, and thus movement commands can be sent to the appropriate machines 18. In the illustrated embodiment, the system controller 24 is programmed with a slight delay (e.g., 100-200 mSecs) between the time it senses that the dead man circuit 34 is ready and the time it sends the movement commands. This delay provides sufficient time for the current in the dead man circuit 34 to stabilize, as described below in more detail.

The dead man trip 40 is a hardware device that will open the dead man circuit 34 if the current in the circuit exceeds a predetermined value. The dead man trip 40 includes a trip contact 44, a current measuring device 46, a comparator 48, a max current source 50, a hold unit 52, and a reset unit 54. The trip contact 44 is a normally closed switch that is coupled to the hold unit 52. The illustrated current measuring device 46 and shunt resistor (R-102) is a high side current measuring device that produces an output voltage corresponding with the current in the dead man circuit 34. The illustrated comparator 48 is an op-amp comparator that receives inputs from the current measuring device 46 and from the max current source 50. If the current in the dead man circuit 34 exceeds the current from the max current source 50, the output of the comparator 48 will cause the trip contact 44 to open. The hold unit 52 will maintain the trip contact 44 in the open position until it is manually reset by a user pressing a reset button 56 of the reset unit 54.

As noted in more detail below, in the illustrated embodiment, when a machine 18 is selected, it will draw 10 mA in the dead man circuit 34. If it is desired to limit the number of selected machines 18 to four, then the maximum current source 50 will be set between 40 mA and 50 mA (e.g., about 45 mA), which will not trip the comparator 48 when four machines 18 are selected (producing 40 mA current in the dead man circuit 34), but will trip the comparator 48 when five machines 18 are selected (producing 50 mA in the dead man circuit 34). In the illustrated embodiment, the max current source 50 can be adjusted depending on the structural integrity or strength of the building into which the system is being installed. In one embodiment, the max current source is a hardware jumper that has four levels, corresponding with the maximum selection of 2, 4, 6, or 8 machines.

As shown in FIG. 2, the dead man circuit 34 also includes a parallel loop 60 in each of the machines 18. Each parallel loop 60 includes a unit select switch 62 that is normally open and is only closed when instructed by the corresponding machine controller 28. In this regard, the machine controller 28 can be coupled to the unit select switch 62 by an opto-coupler 64 in order to electrically isolate the machine controller 28 from the dead man circuit 34.

Each parallel loop 60 further includes a current sink 66 that draws a predetermined current. The current drawn by each current sink 66 represents the "load" of the corresponding machine 18 and related accessory. In the illustrated embodiment, each current sink 66 draws 10 mA, and thus each of the loads is approximated to be the same for purposes of the dead man circuit 34. It should be appreciated, however, that the size (i.e., current draw) of each current sink 66 could be designed to be proportional to the actual mechanical load of the corresponding machine 18 and accessory.

Each parallel loop 60 also passes through the corresponding switching element 32. The illustrated switching element 32 includes a relay 68 and a machine switch 70. The switching element 32 is designed such that the machine switch 70 is normally open, and is only closed when there is current passing though the relay 68. In one embodiment, the switching element 32 includes an opto-coupler 72 in order to electrically isolate the dead man circuit 34 from the machine control link 30.

It should be understood that the above-described components are described in relation to the illustrated embodiment, and their description in a particular orientation would not necessarily be required in order to practice the present invention. For example, while the machine controller 28, switching element 32, unit select switch 62, and current sink 66 are all described and illustrated as being within the confines of the machines 18, some of those components could be positioned outside the machines 18. Similarly, some of the components of the dead man circuit 34 that are illustrated as being positioned in the control center 22 could be positioned outside the control center 22 (e.g., in their own housing).

In operation, the above-described components function to limit the number of machines 18 operating any a given time. Prior to operation of a machine, the dead man enable switch 38 and all unit select switches are open, and thus there is no current flowing in the dead man circuit 34. In addition, the machine switches 70 are open, thus preventing the machine controller 28 from initiating operation of the corresponding machine 18.

Figure 3:
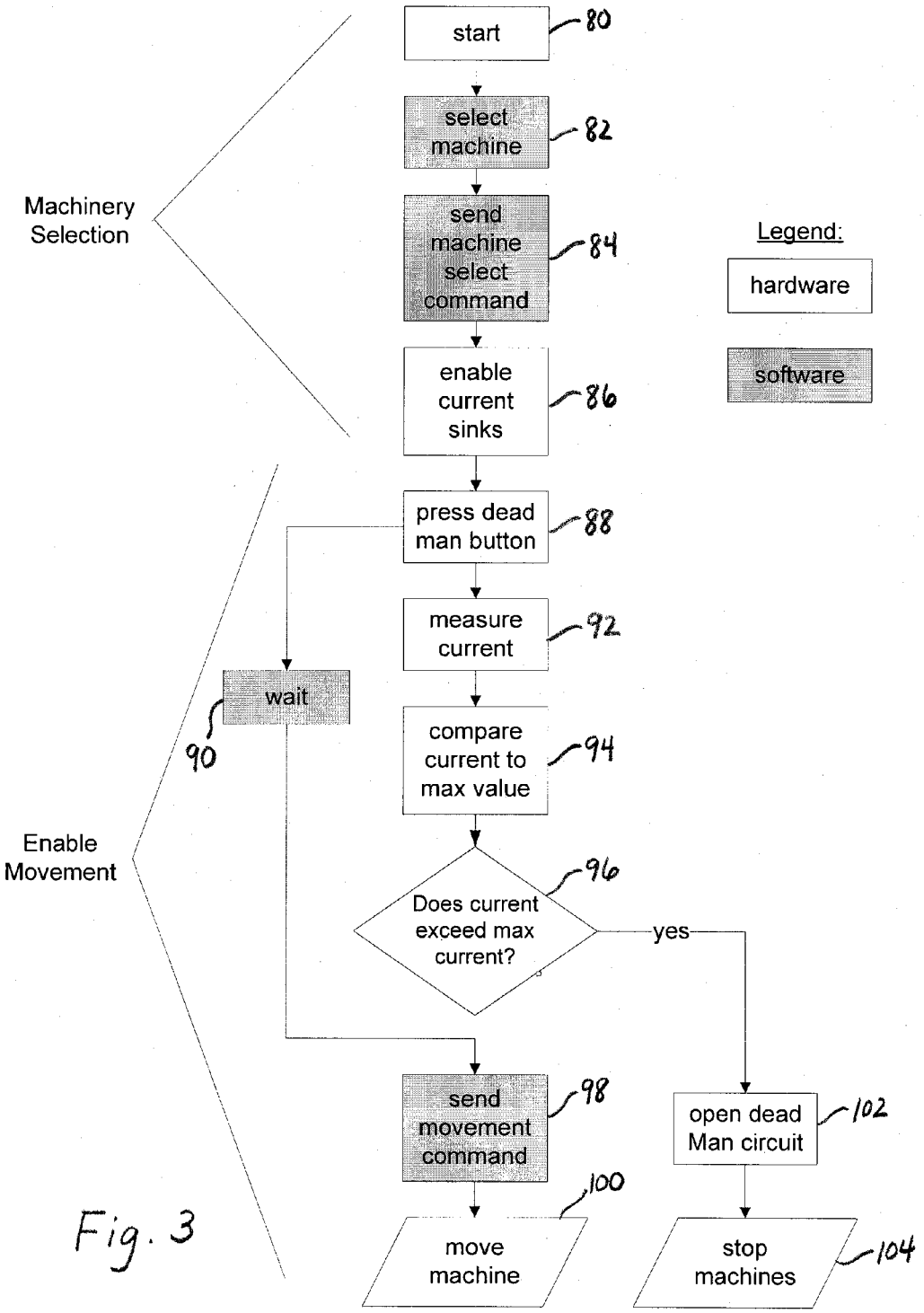
FIG. 3 is a flowchart of a process for operating the dynamic load management system in FIG. 2.
Figure 4:
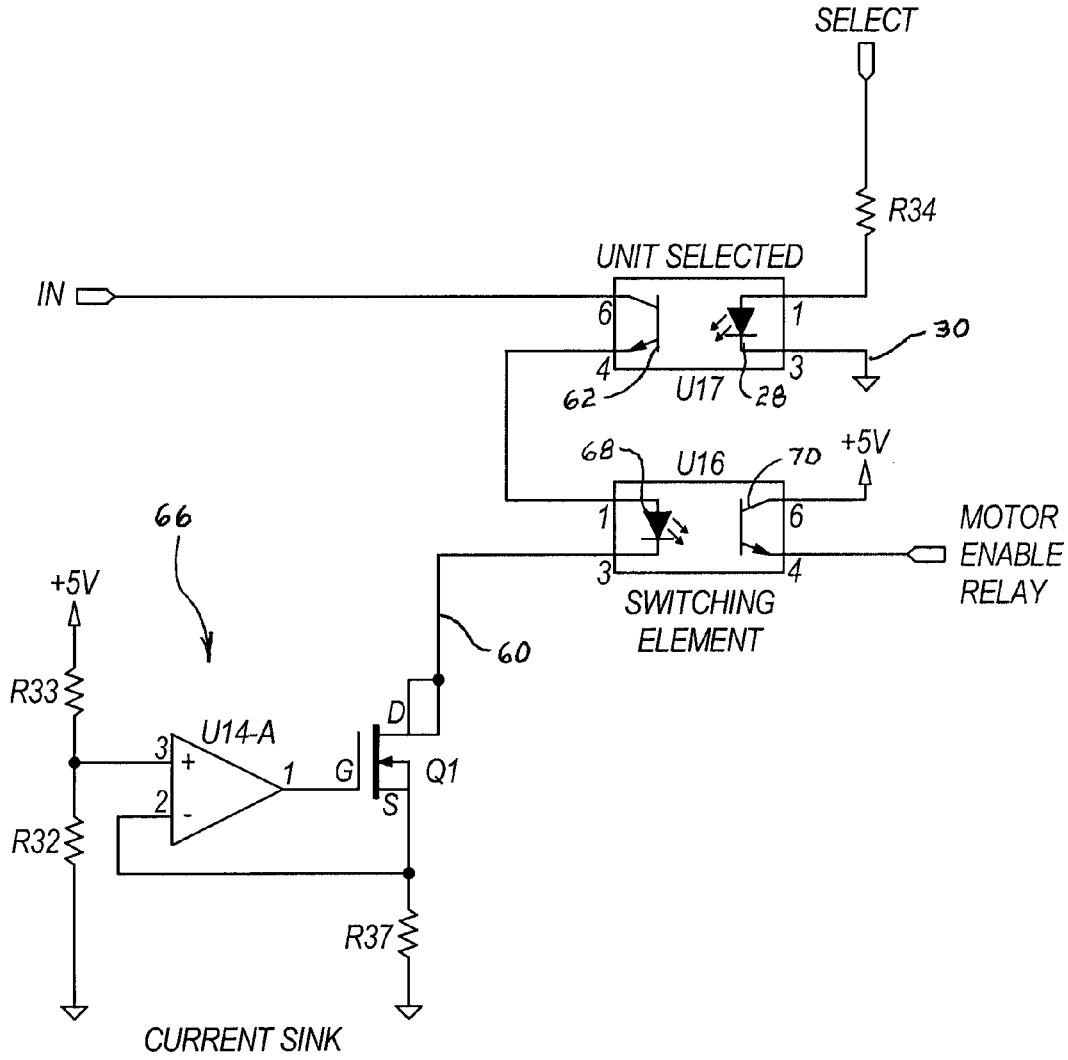
FIG. 4 is a diagram of machine circuitry usable in the dynamic load management system and method in FIGS. 1-3.
Figure 5:
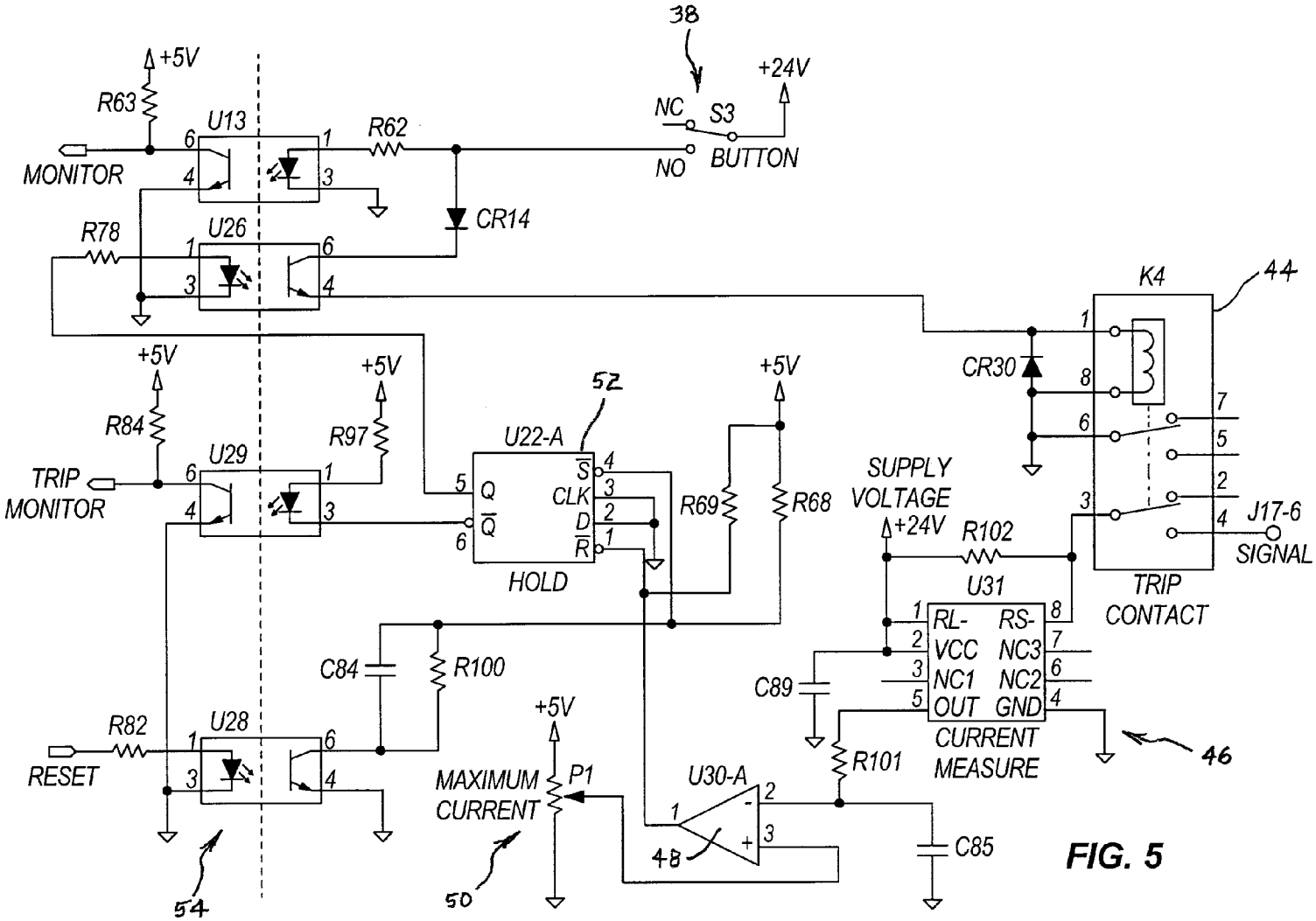
FIG. 5 is a diagram of control center circuitry usable in the dynamic load management system and method in FIGS. 1-3.

Referring to FIG. 3, when operating a machine 18 is desired, a start command 80 is provided to the system controller 24. The following description assumes a single machine 18 is selected, but the same process would be followed if multiple machines 18 are selected. The start command 80 can be in the form of a user selecting operation of the desired machine 18 (e.g., pressing a button), software (internal or external) initiating a programmed operation of the machine, or any other suitable start command. Upon receipt of the start command 80, the system controller 24 selects 82 which machine 18 should be activated, and sends 84 a machine select command 82 via the communication link 26. Upon receipt of the machine select command, the corresponding machine controller 28 closes the corresponding unit select switch 62, which enables 86 the corresponding current sink 66.

The user then must press 88 the dead man button 42, which closes the dead man enable switch 38. This allows current to flow through the dead man circuit 34. More specifically, current will flow through the parallel loop 60 in the selected machine 18, which will close the machine switch 70 corresponding with the selected machine 18.

After the dead man circuit 34 is closed, the system controller 24 waits 90 for about 100 mSecs for the current in the dead man circuit 34 to be filtered, stabilized, and analyzed. The wait period is chosen to be sufficient time for the dead man trip 40 to function prior to movement of the machine(s) 18. That is, the time delay allows the dead man trip 40 to determine whether too many machines 18 have been selected, which would result in tripping the dead man circuit 34 and preventing movement of any machines 18. In this regard, the overload management system of the present invention provides a proactive overload management that is hardware based.

During the wait time, the dead man trip 40 measures 92 the current in the dead man circuit 34 and compares 94 the measured current to a maximum current. At that point, a decision 96 is made whether or not the measured current exceeds the maximum current. If no, then the dead man circuit 34 remains closed, and the system controller 24 will send 98 a movement command to the machine controllers 28 after the above-referenced wait period. This will result in moving 100 the selected machine 18.

Alternatively, if the measured current is above the maximum current, then the dead man circuit 34 is opened 102 by opening the trip contact 44, and the machines 18 are stopped 104 or prevented from moving. In this situation, the trip contact 44 is held open by the hold unit 52, and the hold unit 52 can then be reset by the reset unit 54, as described above.

As noted above, the illustrated embodiment is designed to limit operation of no more than four machines 18 at once. As a result, if start commands are given for five machines 18, the resulting current in the dead man circuit 34 will be 50 mA, which will cause the dead man trip 40 to open the trip contact 44 to disable the dead man circuit 34. With no current flowing through the dead man circuit 34, the switching elements 32 in the machines 18 will revert to their normal states, causing all of the machine switches 70 to open. This cuts communication between the machine controllers 28 and the motors 20, thereby preventing operation of all machines 18.

When a start command is provided while some machines 18 are already moving, the same logic occurs. In this case, however, there is already current in the dead man circuit 34 (from the machines 18 that are already operating). Any additional machines 18 that are selected will then add to the current in the dead man circuit 34. If the total number of machines 18 operating plus the numbers of machines 18 selected for operation exceed the maximum allowable, then the dead man trip 40 will open the trip contact 44, and all machines 18 will be stopped, as described above.

The above-described system provides a means for limiting the number of machines 18 being operated at the same time. The system (i.e., the dead man circuit 34) is purely hardware, and thus is not reliant on proper software operation. It should be understood, however, that this system can be used as a back-up to a software system for limiting operation of the machines 18. That is, the software in the system controller 24 can be programmed such that it will not allow operation of more than the maximum number of machines 18 at the same time. If the software system operates properly, then the load management system of the dead man circuit 34 is not utilized. However, if there is a malfunction of the system software, the dead man circuit 34 will limit the number of machines 18 operating at the same time.

It is also noted that the present invention is capable of not only stopping the machines when too many have been actuated, but also proactively preventing the machines from starting in the first place. In other words, it can prevent the dynamic pulse that occurs when too many machines are started before the machines are started. This is in contrast to a system that has a 3-phase circuit breaker that will only trip after the too machine have started to move, and thus doesn't avoid the start-up pulse caused by too many machines.

Although the present invention has been described with reference to particular embodiments, it should be recognized that these embodiments are merely illustrative of the principles of the present invention. Those of ordinary skill in the art will appreciate that a dynamic load management system and/or method according to the present invention may be constructed and implemented in other ways and embodiments. In addition, where methods and steps described above indicate certain events occurring in a particular order, those of ordinary skill in the art having the benefit of this disclosure would recognize that the ordering of certain steps may be modified and that such modifications are in accordance with the variations of the invention. Additionally, certain of the steps may be performed concurrently in a parallel process when possible, as well as performed sequentially as described above. Accordingly, the description herein should not be read as limiting the present invention, as other embodiments also fall within the scope of the present invention.

What is claimed is:

1. A performance venue comprising:

a plurality of machines, each designed to move a load;

a control center;

a communication link coupling the control center to the machines;

a machine switch coupled to the communication link and a corresponding machine, the machine switch movable between an open position and a closed position, the corresponding machine inoperable to move the load when the machine switch is in the open position and operable to move the load only when the machine switch is in the closed position; and a dead man circuit that draws a current that represents an actual mechanical load of the corresponding machine, the dead man circuit comprising:

a switching element coupled to the machine switch that moves the machine switch to the closed position only when current in the dead man circuit is within a desired range; and a dead man trip that will open the dead man circuit when current in the dead man circuit is outside the desired range, which causes the machine switch to move to the open position.

2. A performance venue as claimed in claim 1, wherein the machines comprise hoists for lifting the loads.

3. A performance venue as claimed in claim 1, wherein the control center includes a system controller coupled to the communication link and operable to provide a machine select command to each of the machines.

4. A performance venue as claimed in claim 3, further comprising a machine controller corresponding with each machine, each machine controller being coupled to the communication link and operable to receive the machine select command, wherein the dead man circuit further includes a unit select switch corresponding with each machine and being movable between an open position and a closed position, and wherein each machine controller is operable to move a corresponding unit select switch to the closed position.

5. A performance venue as claimed in claim 1, including at least one of the machine switches and at least one of the switching elements corresponding with each machine.

6. A performance venue as claimed in claim 1, wherein the dead man circuit further includes a current sink.

7. A performance venue as claimed in claim 6, wherein the dead man circuit includes a plurality of parallel branches corresponding with the plurality of machines, each branch including at least one of the current sinks.

8. A performance venue as claimed in claim 1, wherein the dead man trip comprises a current measuring device, a comparator coupled to the current measuring device, and a trip contact.

9. A performance venue as claimed in claim 8, wherein the dead man trip further comprises a hold unit designed to hold the trip contact open when it is tripped.

10. A performance venue as claimed in claim 1, wherein the dead man circuit is free of software components.

11. A performance venue as claimed in claim 10, wherein the control center is programmed to limit the number of machines operating at a given time, and where the dead man circuit acts as a secondary hardware system for limiting the number of machines operating at a given time.

12. A method of controlling movement of loads in a performance venue, the performance venue including a plurality machines for moving the loads, the method comprising:

selecting at least one of the machines for movement;

closing a dead man circuit that draws a current that represents an actual mechanical load of a corresponding machine;

determining whether the current in the dead man circuit is within a desired range;

after determining whether the current in the dead man circuit is within the desired range, closing a machine switch for the at least one of the machines only when current in the dead man circuit is within the desired range; and opening the dead man circuit if the current in the dead man circuit falls outside the desired range, which causes the machine switch to move to an open position.

13. The method of claim 12, wherein selecting at least one of the machines includes sending a select command to selected ones of the plurality of machines.

14. The method of claim 13, wherein the dead man circuit includes a unit select switch corresponding with each machine, and wherein the method further comprises closing the unit select switch for the selected machines after sending a select command for that machine.

15. The method of claim 12, wherein the performance venue further includes a machine select contact corresponding with each machine, and wherein the method further comprises closing the machine select contacts for the selected machines after closing the dead man circuit.

16. The method of claim 12, wherein the dead man circuit includes a trip contact, and wherein opening the dead man circuit includes:

measuring a current in the dead man circuit;

comparing the measured current to a maximum current; and opening the trip contact if the measured current exceeds the maximum current.

17. The method of claim 16, wherein opening the dead man circuit further comprises holding the trip contact open after opening the trip contact.

18. The method of claim 17, wherein opening the dead man circuit further comprises resetting the trip contact after holding the trip contact open.

19. A performance venue as claimed in claim 1, wherein the dead man circuit includes a dead man enable switch movable between an open position and a closed position.

* * * * *